US006935507B1

(12) United States Patent
Mecca et al.

(10) Patent No.: US 6,935,507 B1
(45) Date of Patent: Aug. 30, 2005

(54) TOUCH UP COSMETIC COMPACT

(76) Inventors: Anna Mecca, 541 Art La., Ridgefield, NJ (US) 07657; John J. Slink, 23 Sheephill Rd., Greenwich, CT (US) 06878

( * ) Notice: Subject to any disclaimer, the term of this patent is extended or adjusted under 35 U.S.C. 154(b) by 545 days.

(21) Appl. No.: 10/024,823

(22) Filed: Dec. 18, 2001

(51) Int. Cl.[7] ..... B65D 69/00

(52) U.S. Cl. ..... 206/581; 206/823; 206/235; 132/295; 220/264

(58) Field of Search ..... 206/235, 581; 220/264, 830, 833, 835, 836; 132/293, 295, 132/300

(56) References Cited

U.S. PATENT DOCUMENTS

| | | | | | |
|---|---|---|---|---|---|
| 3,308,835 | A | * | 3/1967 | Silverberg et al. | 220/263 |
| 4,625,898 | A | * | 12/1986 | Hazard | 222/517 |
| 4,917,131 | A | * | 4/1990 | Contreras, Sr. | 132/301 |
| 4,993,606 | A | * | 2/1991 | Bolen et al. | 222/546 |
| 5,205,431 | A | * | 4/1993 | Zinnbauer | 220/326 |
| 5,358,130 | A | * | 10/1994 | Mengeu et al. | 215/238 |

* cited by examiner

*Primary Examiner*—Jila M. Mohandesi

(57) ABSTRACT

A cosmetic compact that when closed can be opened automatically by momentary finger pressure and when opened can be automatically closed by momentary finger pressure.

3 Claims, 3 Drawing Sheets

TOUCH UP COSMETIC COMPACT

BACKGROUND OF THE INVENTION

Cosmetic compacts that can be manually operated to be opened or closed are well known in the art. The present invention is directed toward a new type of cosmetic compact that when closed can be opened automatically by momentary finger pressure and when opened can be automatically closed by momentary finger pressure.

SUMMARY OF THE INVENTION

A cosmetic compact in accordance with the principles of this invention employs a cover member; a base member; and first means including a cover spring hingedly connecting said members together. The members have a closed position at which the cover member is in complete engagement with the base member and the closed members compress the spring. The members have an open position at which the members are separated, and the spring expands, causing the cover member to extends at approximately 90 degrees to the base member.

The cover member has latch means disposed oppositely to the first means. The base member has latch engagement means disposed oppositely to the first means. The latch means and latch engagement means are mutually engaged when the members are in closed position and are disengaged when the members are in open position.

The latch means has at least one recess and the engagement means includes a latch pin actuated by springs. The pin is moved into engagement with the recess when the members are in closed position and the spring is compressed. When the pin is moved out of engagement with the recess, the spring expands and places the members in open position.

This compact can be automatically opened or closed by momentary finger pressure as disclosed in more detail below.

DETAILED DESCRIPTION OF PREFERRED EMBODIMENTS

Figures 1, 2, 3:
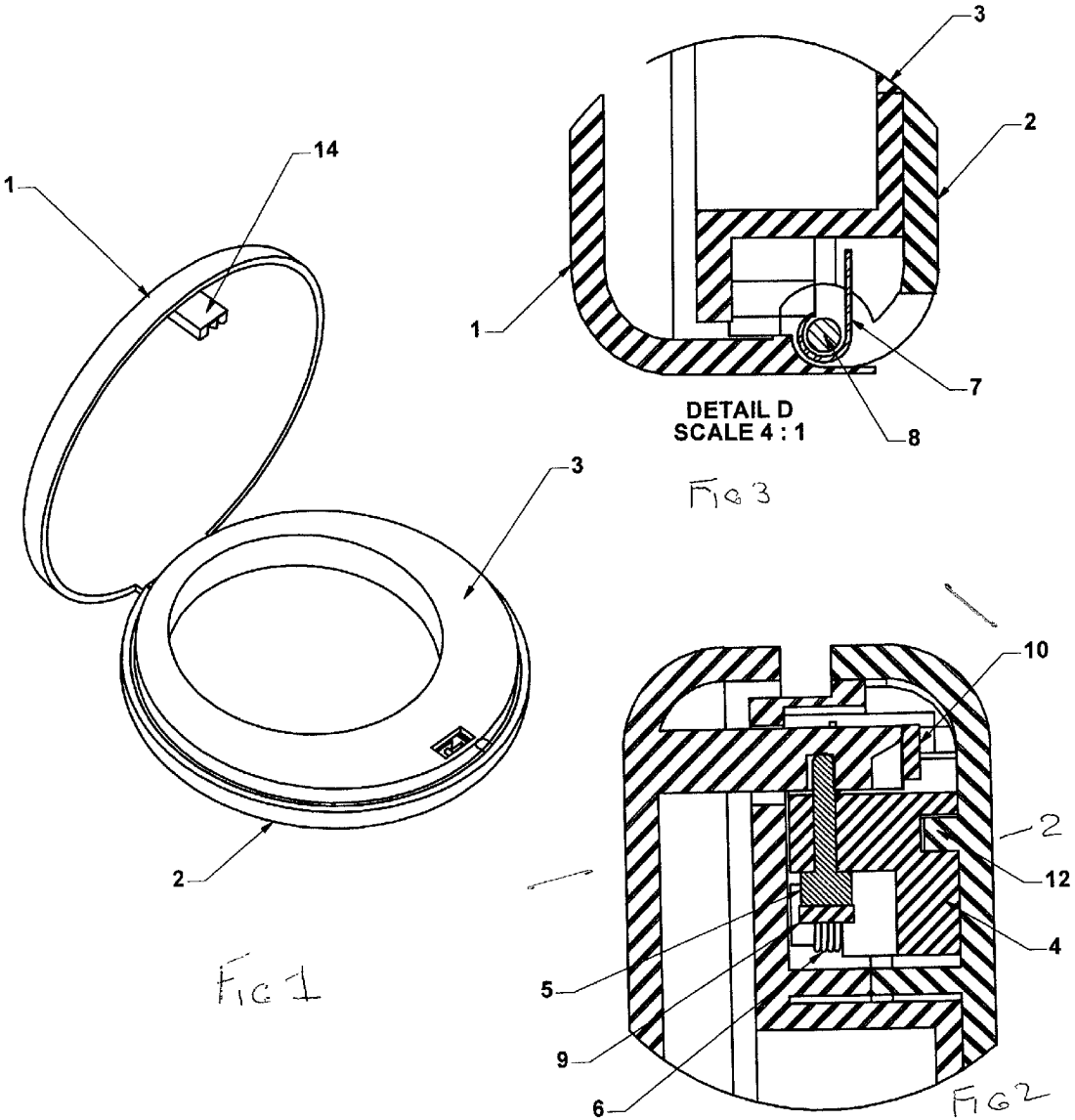
FIG. 1 is a perspective view of the compact as shown in open position.
FIG. 2 is a detail cross sectional view illustrating the detailed construction of the latch engaging mechanism of base member 2.
FIG. 3 is a detail cross sectional view illustrating the hinging arrangement of cover member 1 and base member 2.
Figure 4:
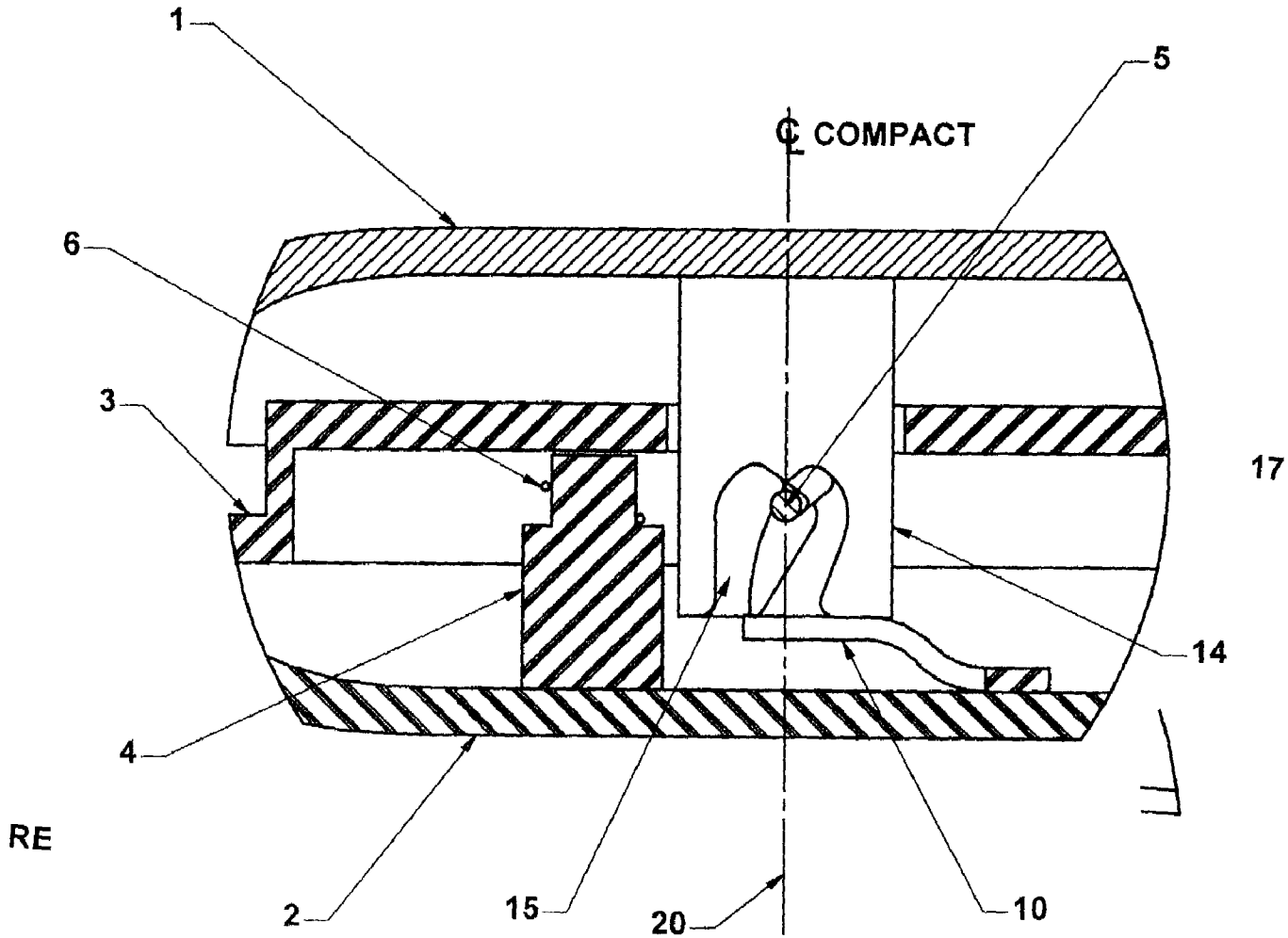
FIG. 4 is a detail cross sectional view of the base and cover members in closed position
Figure 5:
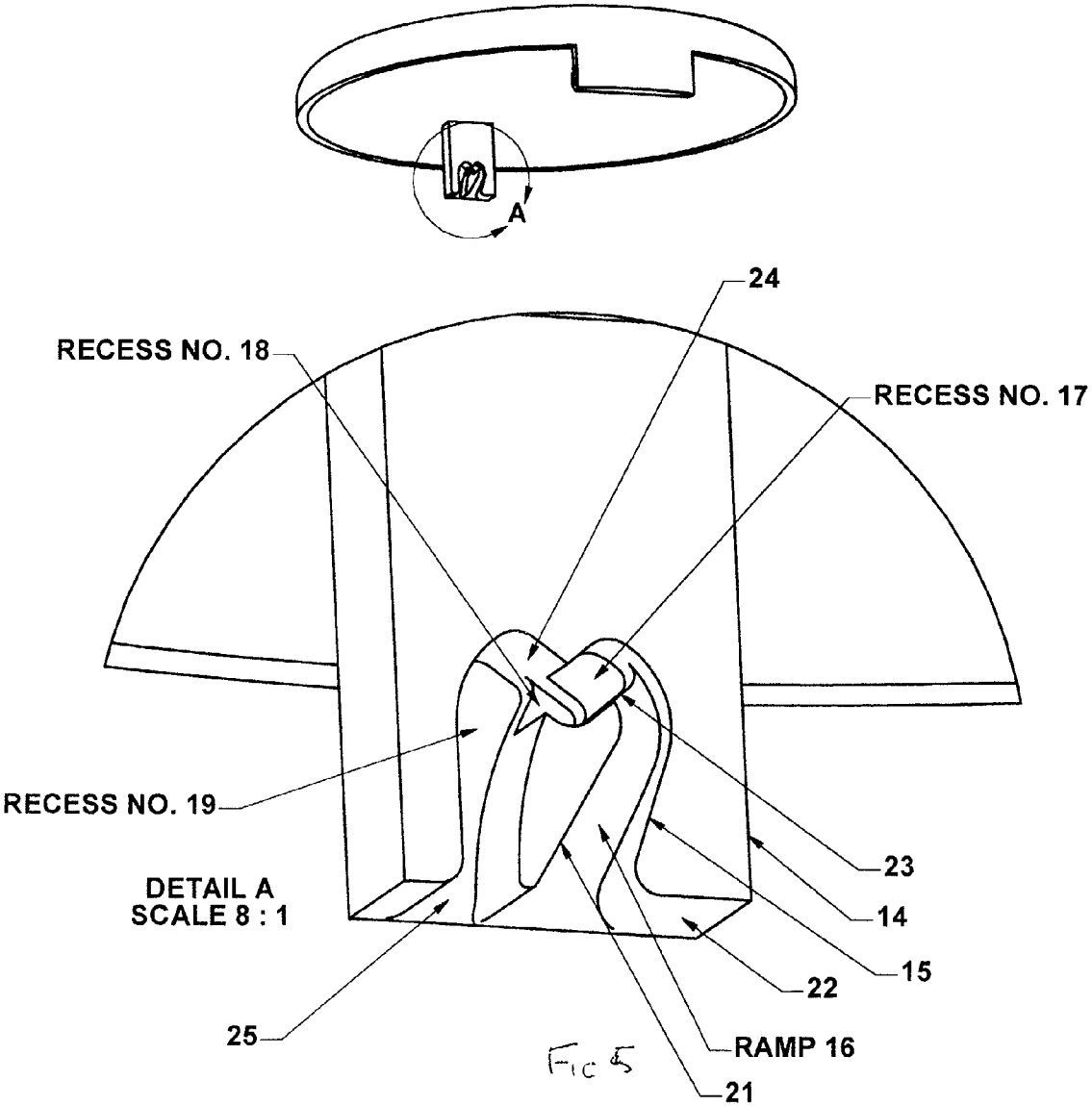
FIG. 5 is an enlarged detail view of the latch mechanism of cover member 1.

In the drawings, the various elements constituting the compact are identified by numbers as follows: cover member 1; base member 2; platform 3; pin retainer 4; latch pin 5; pin retainer spring 6; cover spring 7; hinge pins 8; latch pin spring 9; latch pressure spring 10; pin retainer track 12; latch 14 containing track 15 and bottom surface 22; ram cam 16; recess 17 with latch track 23, recess 18 with side wall 24; recess 19 with latch track 25; center line 20; track 21; bottom surface 22 of latch 14;

Referring now to FIGS. 1–5, members 1 and 2 have a closed locked position at which they fully engage each other and have an open unlocked position at which the members can be disposed at a minimum angle of 90 degrees. The members have concealed mating mechanisms that are engaged when the members are closed and are disengaged when the members are open. These mechanisms are disposed oppositely to small common regions of both members that are hinged together to prevent the members from separating from each other. When the members are in open position, the touch of a finger on the cover member will cause the members to automatically assume the closed position. When the members are in closed position, the touch of a finger on the cover member will cause the members to automatically assume the open position.

Retainer 4, latch pin 5 and pin retainer spring 6 are inserted into member 2. These parts are placed upon pin retainer track 12 that together with a pin retainer locator rib is integral with member 2. This track allows pin retainer 4 to move from left to right. The locator rib fits between the prongs of spring 6. Spring 6 returns retainer 4 in a centralized position that maintains pin 6 at the position of center line 20 when the compact is open. Retainer 4 is thus disposed between platform 3 and member 2. This enables pin 5 to have the side by side movement to follow the track 15 that is in latch 14.

Cover spring 7 is placed in a hole that is provided in the hinge boss of member 1. Member 1 and spring 7 are disposed in the hinge gap of member 2 and are rotated until members 1 and 2 are in closed position. Members 1 and 2 are pinned together using pin 8. As member 1 is placed in closed position with member 2, cover spring 7 is compressed. This spring will expand and in open member 1 to a minimum of 90 degrees with respect to member 2 when the compact is opened.

Latch 14 is secured to member 1. Latch 14 contains track 15 that the latch pin follows and provides the closed position as well as a ramp cam 16 and recesses 17, 18, and 19 which allow for the proper function for the opening and closing of the compact.

When finger pressure is exerted upon the open member to close the compact, pin 5 now disposed at center line 20, enters track 15 and engages cam 16. Pin 5 is forced downward because of the inclined surface of cam 16. As pin 5 moves downward, spring 9 is compressed. At the same time, retainer 4 is driven along the side wall of track 21 until pin 5 snaps into recess 17. This removes the closing pressure, causing spring 10 and spring 9 to move pin 5 out of recess 17 into recess 18 and the compact is closed. Spring 10 bears against the bottom surface of latch 22. Pin 5 is pressurized by spring 9.

In order to open the compact, downward pressure is applied to member 1. The bottom surface of latch 22 applies pressure to spring 10. This pressure together with the remaining pressure of spring 9 moves pin 5 along the side wall 24 of recess 18 into recess 19. The downward pressure is released, and spring 10 together with cover spring 7 acts to move member 1 upward. Spring 6 then causes pin 5 to depart recess 19 via track 25 and returns pin 5 in center line position for subsequent compact closure.

While this invention has been described with particular reference to the drawings and detailed description, the protection solicited is to be limited only by the terms of the claims that follow.

What is claimed is:

1. A cosmetic compact comprising:

a cover member;

a base member;

first means including a cover spring hingedly connecting said members together, said members having a closed position at which the members are in complete engagement causing the spring to be compressed, said members having an open position at which the spring expands causing the cover member to extends at approximately perpendicular to said base member;

said cover member having latch means disposed oppositely to said first means and having first, second and third recesses;

said base member having latch engagement means disposed oppositely to said first means and including a latch pin;

said latch means and latch engagement means being mutually engaged when the members are in closed position; when these means are disengaged, the spring expands and places the members in open position;

a mechanism for moving the pin out of engagement with all of said recesses when the members are in open position and moving the pin into a selected one of said recesses when the members are in closed position.

2. The compact of claim 1 wherein the mechanism moves the pin into the first and then into the second recess during the process of moving the members into closed position.

3. The compact of claim 2 wherein the mechanism moves the pin from the second recess into the third recess and then physically separates the pin from the third recess during the process of moving the members into open position.

* * * * *